US008640369B2

(12) United States Patent
Dysart

(10) Patent No.: US 8,640,369 B2
(45) Date of Patent: Feb. 4, 2014

(54) PORTABLE DIGITAL DISPLAY

(71) Applicant: Arthur L. Dysart, Houston, TX (US)

(72) Inventor: Arthur L. Dysart, Houston, TX (US)

(73) Assignee: Brysart Associates L.L.C., Richmond, TX (US)

( * ) Notice: Subject to any disclaimer, the term of this patent is extended or adjusted under 35 U.S.C. 154(b) by 0 days.

(21) Appl. No.: 13/646,715

(22) Filed: Oct. 7, 2012

(65) Prior Publication Data

US 2013/0100149 A1 Apr. 25, 2013

Related U.S. Application Data

(60) Provisional application No. 61/627,873, filed on Oct. 20, 2011.

(51) Int. Cl.
*G09F 13/00* (2006.01)

(52) U.S. Cl.
USPC ..... 40/549; 362/217.15; 362/249.02

(58) Field of Classification Search
USPC ..... 40/549, 605, 575; 362/217.11, 217.15; 345/39, 40
See application file for complete search history.

(56) References Cited

U.S. PATENT DOCUMENTS

| | | | | |
|---|---|---|---|---|
| 5,588,238 | A * | 12/1996 | Visocky et al. | 40/618 |
| 6,675,514 | B1 | 1/2004 | Salimes | |
| 7,018,129 | B1 | 3/2006 | Smith | |
| 7,194,831 | B1 * | 3/2007 | Cullinan | 40/568 |
| 2005/0178034 | A1 * | 8/2005 | Schubert et al. | 40/605 |
| 2006/0101685 | A1 * | 5/2006 | Smith et al. | 40/556 |
| 2007/0220792 | A1 * | 9/2007 | Capurso et al. | 40/463 |
| 2009/0150242 | A1 | 6/2009 | Del Cogliano | |
| 2011/0258895 | A1 | 10/2011 | Rodgers, Jr. | |
| 2011/0299234 | A1 | 12/2011 | Arboleda | |

* cited by examiner

*Primary Examiner* — Kristina Junge
(74) *Attorney, Agent, or Firm* — Schiff Hardin LLP

(57) ABSTRACT

A portable digital display assembly is disclosed. The portable digital display device is configured to be operated by a wired or wireless device. The portable digital display is battery powered and has arrays of LED's configured to creating a display.

The portable digital display is configured for rapid assembly and disassembly. The operating system is contained within a frame system of the portable digital display. The portable digital display is preferably comprised with no metal in its infrastructure.

11 Claims, 6 Drawing Sheets

PORTABLE DIGITAL DISPLAY

The present application claims the benefit of U.S. application No. 61/627,873 filed on Oct. 20, 2011 and entitled Portable Digital Display, which is herein incorporated by reference in its entirety.

FIELD OF THE INVENTION

The technology described herein relates generally to displays. In particular the technology described herein pertains to portable digital signage display devices.

BACKGROUND OF THE INVENTION

A display device is an output device for presentation of information in visual or tactile form (the latter used for example in tactile electronic displays for blind people). When the input information is supplied as an electrical signal, the display is called an electronic, or digital, display.

An electronic visual display is display technology which incorporates flat panel displays, performs as a video display, output device for presentation of images transmitted electronically, for visual reception, without producing a permanent record.

Common applications for electronic visual displays used to be television sets or computer monitors, but these days electronic visual displays tend to be ubiquitous as interface for large amounts of visual information in mobile computing applications like portable information communication technology devices. They can also be found in digital signage.

Digital signage is a form of electronic display that shows television programming, menus, information, advertising and other messages. Digital signs (frequently utilizing technologies such as LCD, LED, plasma displays, or projected images to display content) can be found in both public and private environments, including retail stores, hotels, restaurants, and corporate buildings, amongst other locations.

Digital signage displays are most commonly controlled by personal computers or servers, through the use of either proprietary or public-domain software programs; this approach often allows the operator to avoid large capital outlays for the controller equipment.

Advertising using digital signage is a form of out-of-home advertising in which video content, advertisements, and/or messages may be displayed on digital signs with a common goal of delivering targeted messages, to specific locations and/or consumers, at specific times.

Digital signage is used for many different purposes and there is no definitive list. However, below are some of the most common applications of digital signage:

a. Public information—news, weather and local (location specific) information, such as fire exits and traveler information.
b. Internal information—corporate messages, such as health & safety items, news, and so forth.
c. Menu information—pricing, photos, ingredients, and other information about the food(s) being offered, including nutritional facts.
d. Advertising—usually either related to the location of the signage or using the audience reach of the screens for general advertising.
e. Brand building—in-store digital signage to promote the brand and build a brand identity.
f. Influencing customer behavior—directing customers to different areas, increasing the "dwell time" on the store premises, and a wide range of other uses in service of such influence.

g. Enhancing customer experience—applications include the reduction of perceived wait time in the waiting areas of restaurants and other retail operations, bank queues, and similar circumstances, as well as demonstrations, such as those of recipes in food stores, among other examples.
h. Enhancing the environment—with interactive screens (in the floor, for example, as with "informational footsteps" found in some tourist attractions, museums, and the like) or with other means of "dynamic way-finding".

Since digital signage content may be both frequently and easily updated, saving the printing and/or construction costs associated with static signage, and also because of the interactive abilities available through the accompanying employment of such real-world interfaces as embedded touch screens, movement detection and image capture devices, it has won wide acceptance in the marketplace.

Content, in the context of digital signage, is the name used to describe anything designed and displayed on screens. Content is wide and varied, and indeed may be of any variety, including text, images, animations, video, audio, and interactivity. It has frequently been argued that digital signage must rely on useful content if it is to work effectively.

While the technology is well-established, it is often the content that fails, perhaps because marketers have not yet widely adapted their thinking to produce appropriate and engaging content.

Content design (much like the design for static signage) is typically done through a specialist agency or, alternatively, by an "in-house" individual, team, or department. While there are a great number of different software solutions available, the most popular are proprietary to digital signage. The use of other systems to run a digital signage network often does not provide the necessary flexibility and management, as the proprietary software can create conflicts with open-source software.

In many digital signage applications, content must be regularly updated to ensure that the correct messages are being displayed. This can either be done manually as and when needed, through a scheduling system, using a data feed from a content provider.

Digital signage relies on a variety of hardware to deliver the content. The components of a typical digital signage installation include one or more display screens, one or more media players, and a content management server. Sometimes two or more of these components are present in a single device but typically there is a display screen, a media player, and a content management server that is connected to the media player over a network. One content management server may support multiple media players and one media player may support multiple screens. Stand-alone digital signage devices combine all three functions in one device and no network connection is needed.

LED matrix displays often use modular display components, to allow for varying sizes and shapes of displays, and to make assembly and construction easier. A modular display consists of two parts:

a. display matrix modules (8×8 pixels, 16×16 pixels, 8×16 pixels, etc.)
b. display matrix controller For example, a variable-size display may use modules 16 LEDs wide and 16 LEDs tall. To construct a display 64 pixels wide and 32 pixels tall, the display is built using a construct four modules wide and two modules tall. To correctly align the individual modules, either a support frame is used or the modules are joined together along the edges.

Matrix modules may be joined to the controller using individual data connectors, thereby limiting display area expansion to the total number of data connectors available on the controller, or the modules may communicate with the controller using a shared data bus, and the position of the matrix module to display its portion of the overall image is assigned via a data bus ID number or matrix position code.

Re-use of position/bus-ID codes allows for more than one matrix module to display the same information. In this manner a double-sided or quad-sided display can be constructed using a single matrix display controller, and reusing all module position/bus-ID codes on each face of the display.

In either case, unusual non-rectangular display shapes can sometimes also be constructed by using the tiles in a free-form construction, skipping module locations in the matrix. Very large displays can be built to span across physical gaps in space where module mounting is otherwise impossible, but the disjointed modules still form a coherent image coordinated with other modules in the matrix.

Standard LCD or plasma video displays may also be combined in this manner using a special VGA matrix controller, but typically there is unusable display area around the perimeter of a standard LCD or plasma panel which cannot be hidden, so combined LCD panels tend to have the appearance of an image broken into tiles.

Digital signage can interact with mobile phones. Using SMS messaging and Bluetooth (a standardized wireless communication technology and protocol for exchanging data over short distances from fixed and mobile devices), both of which are wireless communications technologies, some networks are increasing the interactivity of the audience. SMS systems can be used to post messages on the displays, while Bluetooth allows users to interact directly with what they see on screen. In addition to mobile interactivity, networks are also using technology that integrates social and location-based media interactivity. This technology enables end users to send Twitter and Flickr messages as well as text messages to the displays.

One problem with traditional signs is that they are not readable from a distance.

Another problem with traditional signs pertains to portability.

Another problem with traditional signs is the inability to react immediately with a timely message, especially during an event, since this is impractical with paper and marking pens. One attempt to solve this problem is to use a megaphone to communicate timely messages.

Another problem with traditional signs is the lack of a memory; once a traditional sign has been replaced, the "memory" is gone.

Another problem with traditional signage used in sports venues is that they are subsequently discarded as trash and end up in landfills.

These and other problems need to be addressed.

Related patents and published patent applications known in the background art include the following:

U.S. Pat. No. 6,675,514, issued to Salimes et al. on Jan. 13, 2004, discloses a display enclosure which includes a case, a driver board assembly configured to provide signals to a display, a clamp assembly having a head configured to slidably engage the case and a protrusion configured to secure the driver board assembly to the case. A message center enclosure includes a case, a driver board assembly configured to generate a display, a pivot clamp assembly coupled to the case, and configured to couple the driver board assembly to the case, in a manner that is devoid of apertures through the driver board assembly for coupling the driver board assembly to the case. A method of manufacturing a message center enclosure includes obtaining a case having opposing first and second ends and at least one pivot clamp assembly, sliding a driver board assembly into the case, and sliding the pivot clamp assembly into the case.

U.S. Pat. No. 7,018,129, issued to Smith on Mar. 28, 2006, discloses a guardrail comprising a rail and an electronic display mounted on the rail. The display may be integrated with a bar code or RFID reader and a voice-recognition module.

U.S. Published Patent Application 2009/0150242, inventor Del Cogliano, published on Jun. 11, 2009, discloses a method and system for displaying selected advertisements on a vehicle for external viewing with the advertisements being selected based on the location and direction of movement of the vehicle when moving along a highway having a plurality of exits defined by exit zones, the exit zones being separated by non-exit zones, which includes the steps and related components for determining the position and direction of movement of the vehicle; storing exit coordinates and local advertisements of local advertisers; and displaying at least one stored local advertisement of at least one local advertiser located at a given exit when the vehicle is in a given exit zone. Non-exit specific advertisements may be displayed when local advertisements are not displayed.

U.S. Published Patent Application 2011/0258895, inventor Rodgers, Jr. published on Oct. 27, 2011, discloses methods and an apparatus for an automobile message display device. The device allows a user to compose a message on a first device, such as a cell phone, computer, or other personal electronic device and download the message to the automobile message display device. This download may be accomplished with a cable connection, or may be done wirelessly. A further embodiment allows for wireless reception of coded messages received from message transmitters. These messages are then displayed on the automobile message display device.

U.S. Published Patent Application 2011/0299234, inventor Layva Arboleda et al., published on Dec. 8, 2011, discloses a digital system for graphically displaying information with various applications such as, inter alia, advertising, commercial information, signposts, instructions; the system being able to be dismantled and being lightweight and portable; the system can be packed in a special hard container which may include wheels on the base thereof in order to facilitate the transport thereof to any location.

U.S. Pat. Nos. 6,675,514 and 7,018,129, plus published patent applications 2009/0150242, 2011/0299234 and 2011/0258895, are herein incorporated by reference in their entirety.

A portable digital sign that addresses and overcomes the numerous problems cited above is needed.

The foregoing patent, patent publication and non-patent information reflect the state of the art of which the inventor is aware and is tendered with a view toward discharging the inventor's acknowledged duty of candor in disclosing information that may be pertinent to the patentability of the technology described herein. It is respectfully stipulated, however, that the foregoing patent and other information do not teach or render obvious, singly or when considered in combination, the inventor's claimed invention.

BRIEF SUMMARY OF THE INVENTION

The technology described herein pertains to a portable digital display device that can be operated wired and/or wireless devices. The technology described herein can be configured for connecting and communicating wirelessly to other devices. The portable digital display is preferably battery powered and has arrays of LED's configured for creating a visual display.

The portable digital display is configured for rapid assembly and disassembly. The operating system is contained within a frame system of the portable digital display. The portable digital display is preferably comprised with no metal in its infrastructure. In one embodiment the portable digital display consists of a 4-part self-contained frame system plus 5 LED strips, all configured for rapid assembly and disassembly.

In an exemplary embodiment the technology described herein is comprised of a plurality of LED (light emitting diode) strips and a frame system.

Each LED strip is substantially rectangular in shape and has one of more of a frame connector disposed on its left frame facing side as well as its right frame facing side. In a typical arrangement four or five LED strips are used. In some embodiments the LED strips are replaced with a flexible mesh/roll type LED structure.

Each LED strip is comprised of arrays of LEDs; the LEDs are connected to wiring. The wiring connects the LED arrays through either a left frame connector or a right frame connector.

The frame system is lightweight and preferably formed from plastic or other rigid non-metal material. The frame system is comprised of a top frame piece, a bottom frame piece, a left side frame piece and a right side frame piece. Each frame piece is formed with a hollowed groove shaped recess in a portion of its LED assembly facing side.

This hollow middle groove is dimensioned for one or more purposes, e.g., connecting to the LED assembly, containing the controller-memory assembly, containing the power assembly, providing for at least one USB connection, providing for a battery recharge port, providing for an AC adapter, and the like.

Each frame piece is configured to connect with its two corresponding frame pieces, e.g. the top frame piece is configured to connect to the top of the left side frame piece and the top of the right side frame piece, and the bottom frame piece is configured to connect to the bottom of the left side frame piece and the bottom of the right side frame piece.

The frame system is further comprised of a controller-memory assembly configured with one or more applications for receiving, storing and displaying information, e.g. alphanumeric characters, symbols and graphics. The controller-memory assembly is dimensioned to fit inside a frame assembly groove, preferably in the bottom frame piece. The controller-memory assembly can be further comprised of a voice-activated interface, e.g. an app.

The frame system is further comprised of a power assembly, e.g., a rechargeable/replaceable battery, an AC adapter connection, a solar cell, that is operably connected to the controller-memory assembly.

The frame system is further comprised of a data input interface, e.g., a USB port, an internet connection, a WI-FI interface, a Bluetooth interface, that is operably connected to the controller-memory assembly.

The left frame element and right frame element are further comprised of LED strip connectors configured to releasably attach to a corresponding LED frame connector.

Electrical connectivity is provided from the power source to the controller-memory assembly through the frame assembly to the LED strips by wiring. The connector system is configured not only for physical connections for frame-element-to-frame-element and frame-element-to-LED strips, but also for electrical connections through frame-element-to-frame-element and frame-element-to-LED-strip.

The frame assembly is further comprised of a removable LED stabilizing lip/rim configured for attachment to the groove recess to facilitate structural integrity of the assembled frame pieces to the LED strips.

The portable digital display is constructed as follows:

a. Provide five LED strips;
b. Provide a frame assembly consisting of a left side frame piece, a right side frame piece, a top side frame piece and a bottom side frame piece;
c. Attach a removable LED stabilizing lip/rim to each frame piece, two per frame piece; one on each side of the frame groove;
d. Attach the left frame piece to the bottom frame piece;
e. Attach the right frame piece to the bottom frame piece;
f. Position one LED strip into the groove of both side frame pieces, between the Lip/Rim attachments;
g. Gently slide the strips down the side frame grooves until it is inserted evenly and parallel to the groove of the bottom frame piece and connect each side of the LED strip to the corresponding frame connector;
h. Repeat the LED assembly process with all of the LED strips—each LED strip when properly inserted will rest stacked on top of the previously installed LED strip;
i. When all LED strips have been inserted and connected, attach the top frame piece;
j. Insert and tighten plastic screws.

The technology described herein is configured for interacting with a smartphone, iPad and the like, either by a USB connection or wireless. By keying in a visual message, these devices are used to formulated and/or program information for the purpose of displaying that information on the portable digital display In one embodiment of the technology described herein an "app" is configured for voice input to the portable digital display, e.g., commands, display text.

An aspect of the portable digital display is that it is consists of several interlocking pieces that can be assembled quickly.

An aspect of the portable digital display is that the enabling elements are self-contained in either the frame system or LED strips.

An aspect of the portable digital display is that it offers significant advantages over traditional paper or cardboard signs.

An aspect of the portable digital display is that it can serve as a "digital counterpart to the electronic megaphone".

An aspect of the portable digital display is that it has a memory.

An aspect of the portable digital display is that it can be configured for communicating with wired and/or wireless devices, e.g. Bluetooth technology, internet connectivity.

An aspect of the portable digital display is that is can be utilized:

a. in sports venues
b. by a private business venture for rental purposes
c. in political campaigns
d. by businesses
e. in conventions
f. for advertising
g. by governments
h. during construction An aspect of the portable digital display is to provide an individual with the opportunity for public expression of a thought or gesture.

An aspect of the portable digital display is to provide a user the opportunity to publically display a notice, give a warning, or give direction with a portable, individual digital sign that can be quickly updated as needed via a smart phone or miniature key pad.

There has thus been outlined, rather broadly, the features of the present invention in order that the detailed description that follows may be better understood, and in order that the present contribution to the art may be better appreciated. There are additional features of the invention that will be described and which will form the subject matter of the claims. Additional aspects and advantages of the present invention will be apparent from the following detailed description of an exemplary embodiment which is illustrated in the accompanying drawings. The invention is capable of other embodiments and of being practiced and carried out in various ways. Also, it is to be understood that the phraseology and terminology employed are for the purpose of description and should not be regarded as limiting.

BRIEF DESCRIPTION OF THE DRAWINGS

The technology described herein will be better understood by reading the detailed description of the invention with reference to the accompanying drawing figures, in which like reference numerals denote similar structure and refer to like elements throughout, and in which.

DETAILED DESCRIPTION OF THE INVENTION

Figure 1:
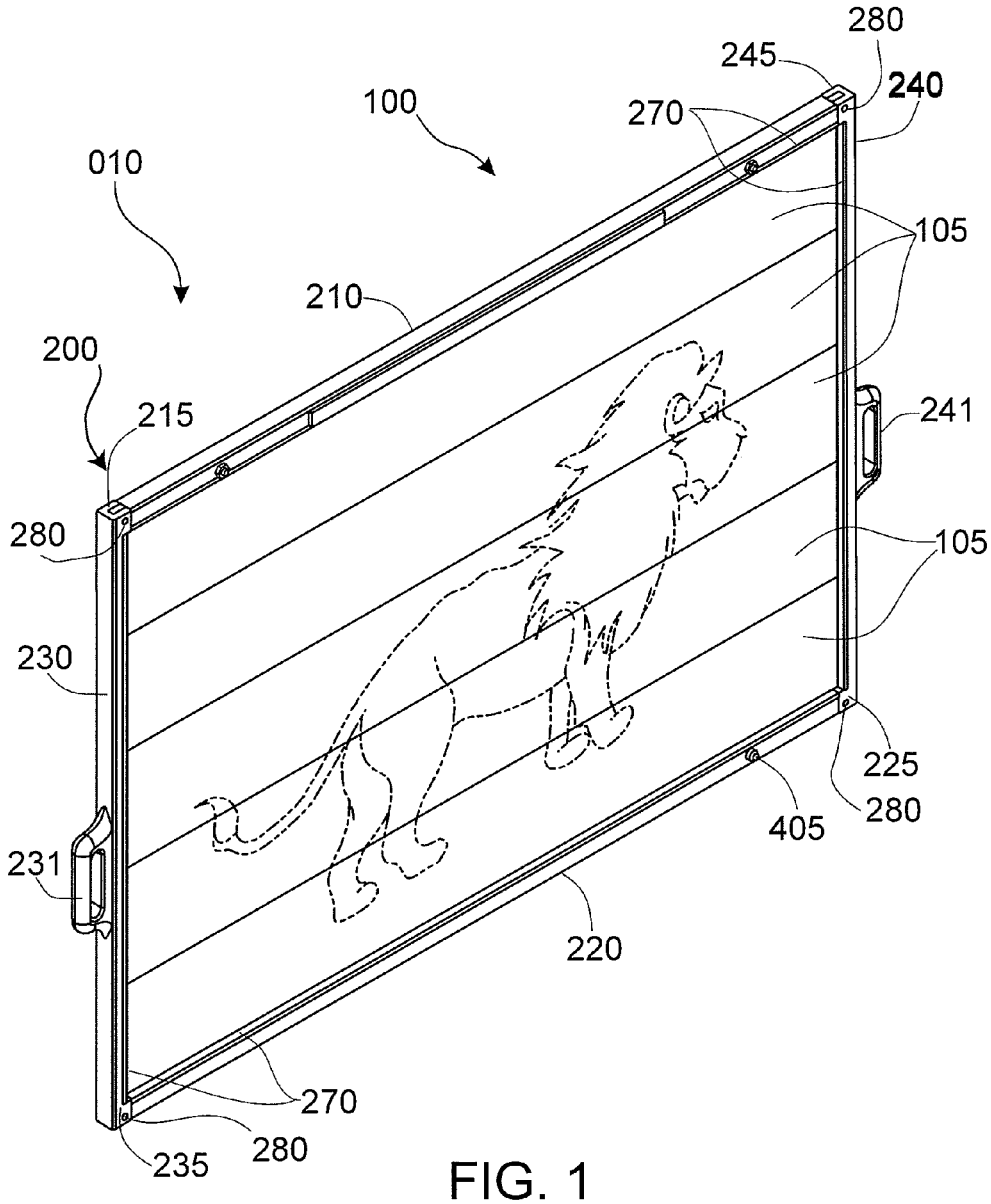
FIG. 1 is a front isometric view of a portable digital display, illustrating, in particular, a graphical image displayed on the front side of the portable digital display, according to an embodiment of the technology described herein.
Figure 2:
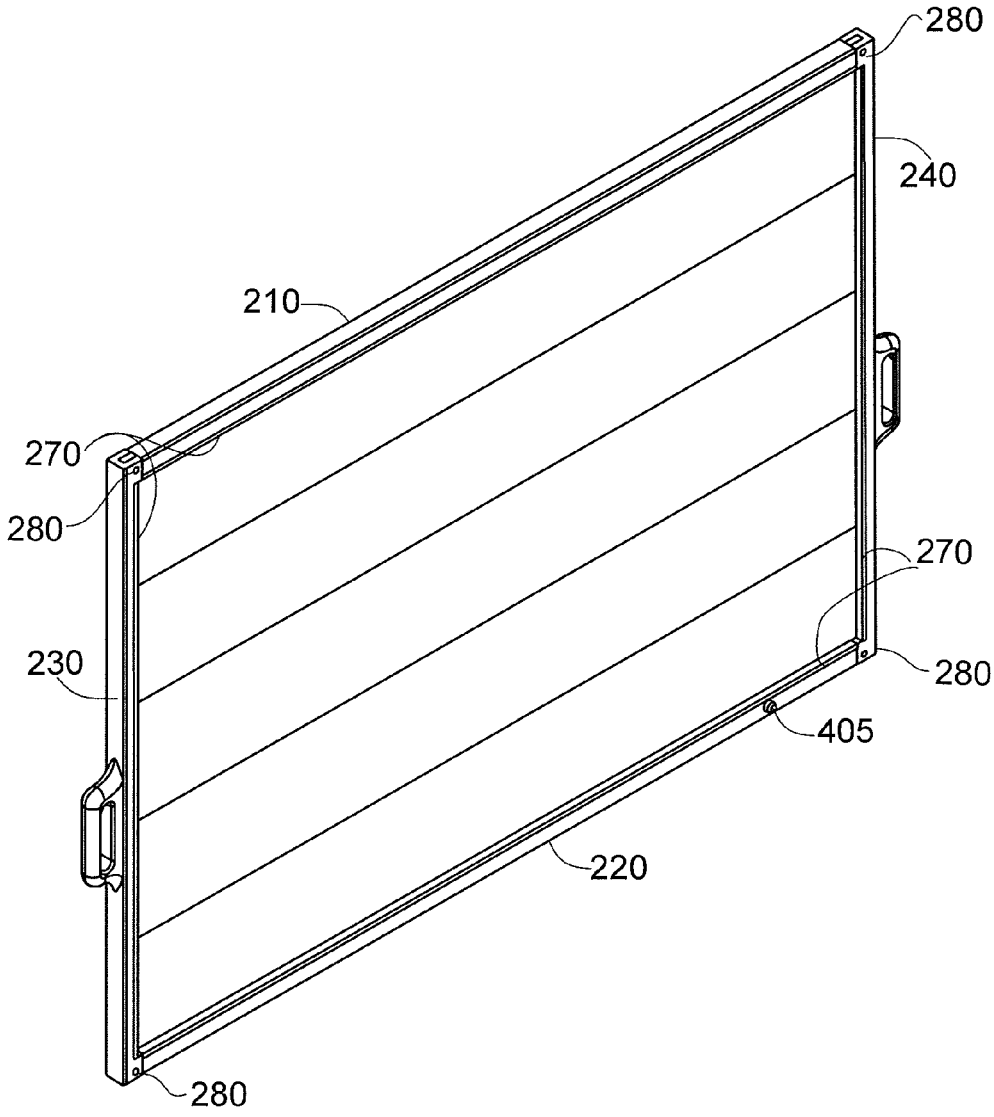
FIG. 2 is a front isometric view of the portable digital display of FIG. 1, without a graphical image displayed on the front side of the portable digital display.
Figure 3:
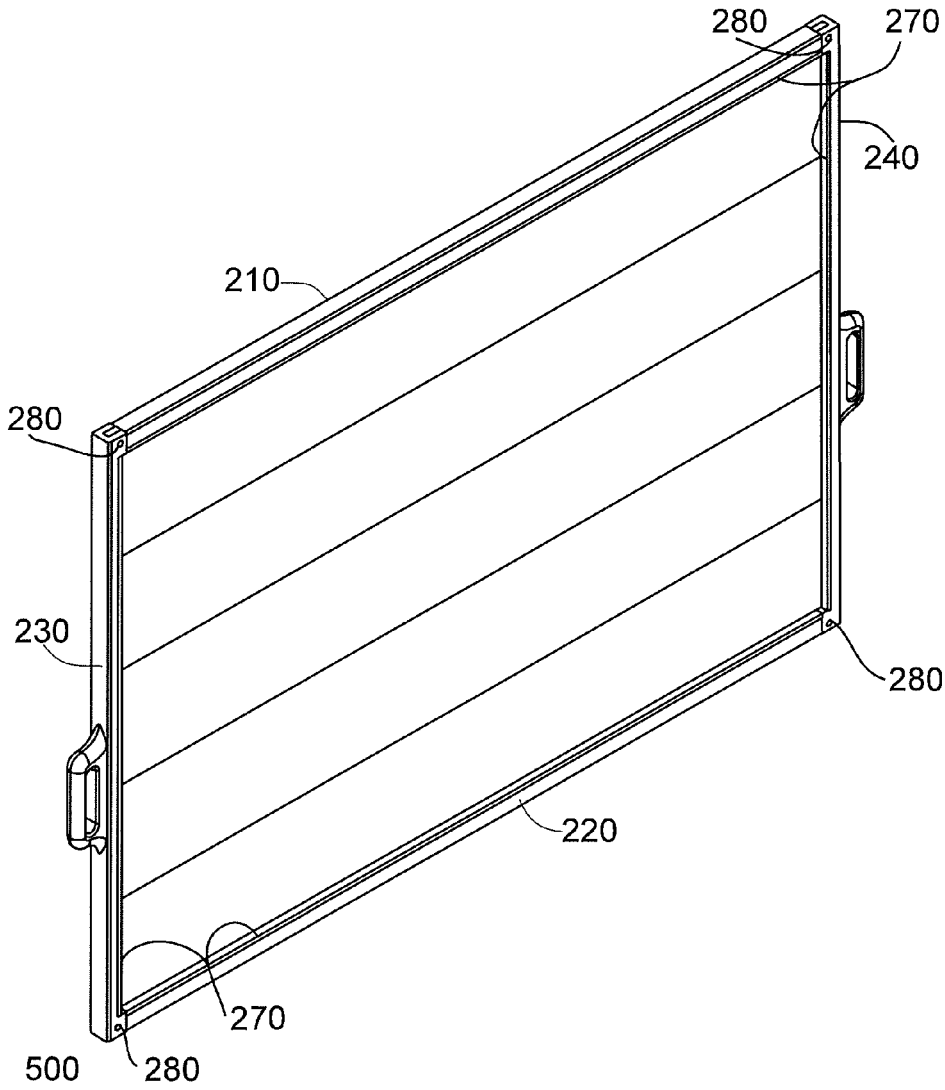
FIG. 3 is a rear isometric view of the portable digital display of FIG. 2.
Figure 4:
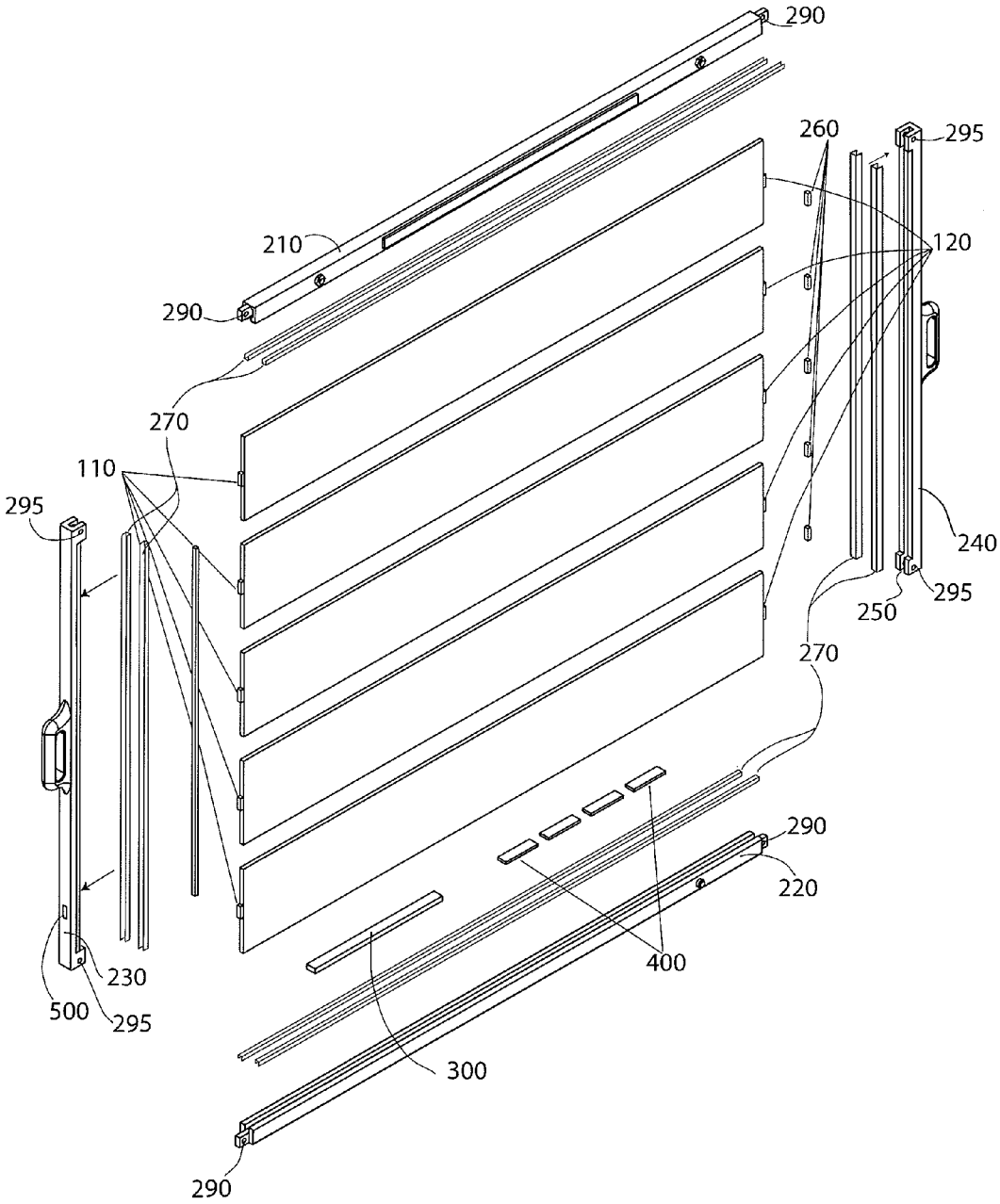
FIG. 4 is a partially exploded front isometric view of a portable digital display, illustrating, in particular, the frame system elements and the LED strip elements, according to an embodiment of the technology described herein.
Figure 5:
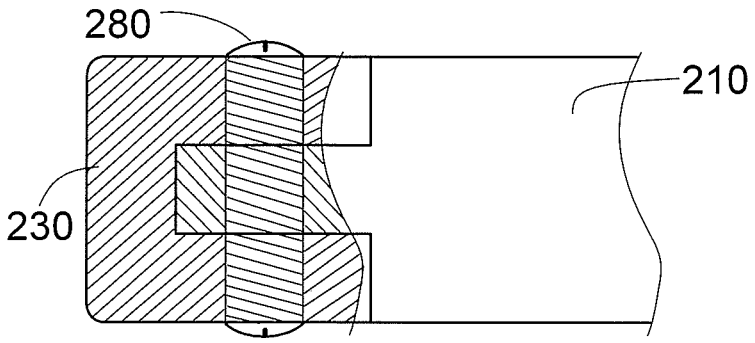
FIG. 5 is a partial cross-sectional top detail view of the corner of a top frame piece, illustrating, in particular, how the top frame piece connects to a left side frame piece, according to an embodiment of the technology described herein.
Figure 6:
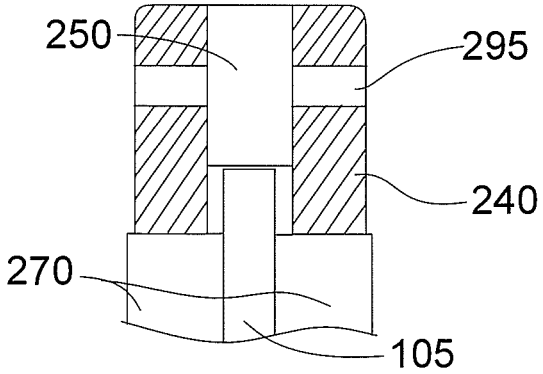
FIG. 6 is a partial cross-sectional right side detail view of the upper end of a left side frame piece as disclosed herein, illustrating the LED stabilizing rims mated onto the side walls that form the recessed groove in the left frame piece, an LED strip slidably mated between the stabilizing rims in the recessed groove, and a partial cross-section showing a through hole for securing the left side frame piece to a top frame piece; and herein.
Figure 7:
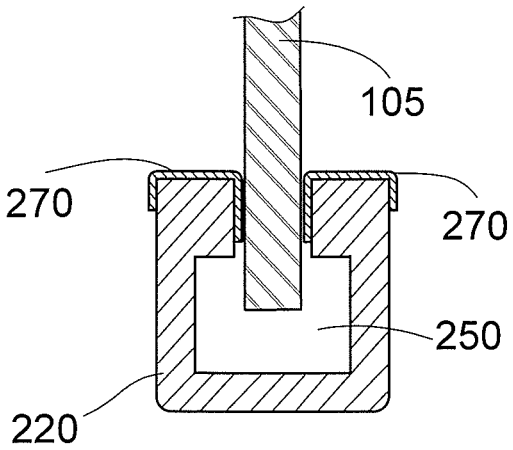
FIG. 7 is a partial cross-sectional side view of a bottom frame piece, illustrating, in particular, how the rim pieces are mated into the recessed grooves of the frame pieces, according to an embodiment of the technology described herein.
Figure 8:
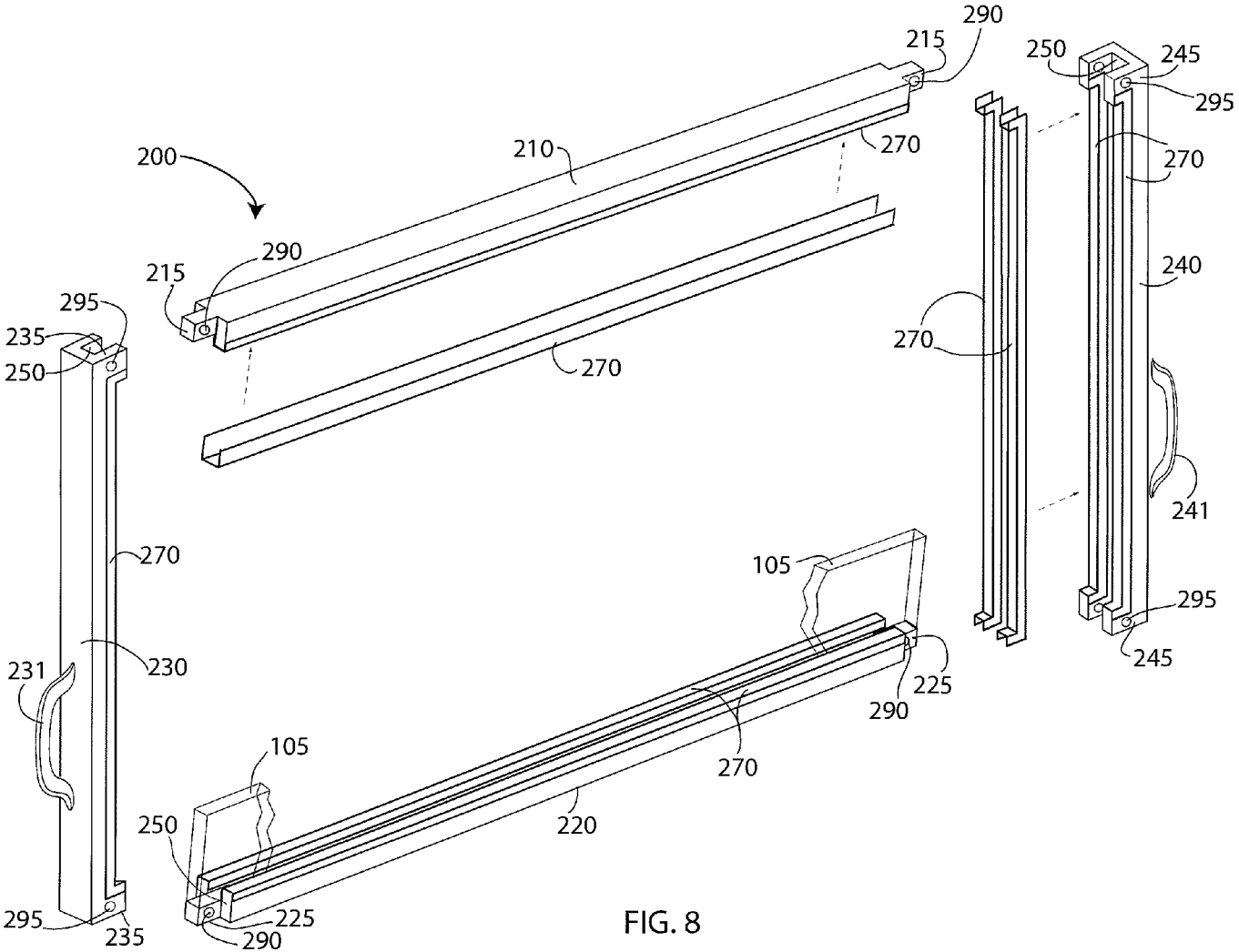
FIG. 8 is a partially exploded front isometric view of an embodiment of a portable digital display, illustrating the LED stabilizing rims that may be mated to the frame pieces to support the LED strips in the collapsible frame.

In describing the preferred and other embodiments of the technology described herein, as illustrated in FIG. 1-7, specific terminology is employed for the sake of clarity. The invention, however, is not intended to be limited to the specific terminology so selected, and it is to be understood that each specific element includes all technical equivalents that operate in a similar manner to accomplish similar functions.

Referring now to FIGS. 1-7, illustrated therein is a portable digital display 010.

In an exemplary embodiment the portable digital display 010 is comprised of an LED assembly 100, e.g., a plurality of LED (light emitting diode) strips 105, and a frame assembly 200.

Each LED strip 105 is substantially rectangular in shape and has one of more of a LED assembly frame connector disposed on its left frame facing side as well as its right frame facing side. In a typical arrangement four or five LED strips 105 are used. In some embodiments the LED strips 105 are replaced with a flexible mesh/roll type LED structure (not shown).

Each LED strip 105 is comprised of arrays of LEDs; the LEDs are connected to LED wiring (not shown). The LED wiring connects the LED arrays to either an LED left frame connector 110 or an LED right frame connector 120, disposed on the frame facing side of the LED strip 105.

The frame pieces are lightweight and preferably formed from plastic or other rigid non-metal material. The frame assembly 200 is comprised of a top frame piece 210, a bottom frame piece 220, a left side frame piece 230 and a right side frame piece 240. Each frame piece is formed with a frame recess 250, e.g. a frame piece customized hollowed groove shaped recess, in a portion of each frame piece's LED assembly facing side.

This frame recess 250 is dimensioned for one or more purposes, e.g., connecting to the LED assembly 100, containing a controller-memory assembly 300, containing a power assembly 400, providing for at least one input interface 500, e.g., a USB connection, providing for a battery recharge port, providing for an AC adapter, and the like.

Each frame piece is configured to connect with its two corresponding frame pieces, e.g. the top frame piece 210 is configured to connect to the top of the left side frame piece 230 and the top of the right side frame piece 240 (using each of the top frame piece side frame connector 215 and the left side frame corner connector 235 and the right side frame corner connector 245) and the bottom frame piece 220 is configured to connect to the bottom of the left side frame piece 230 and the bottom of the right side frame piece 240 (using each of the bottom frame piece side frame connector 225 and the left side frame corner connector 235 and the right side frame corner connector 245). In one exemplary embodiment, the top and bottom frame piece side frame connectors 215, 225 are formed as protrusions having a through hole 290 defined therein. The left and right side frame corner connectors 235, 245 are formed as slots having a pair of sidewalls through which through holes 295 are defined. The protrusions of the top and bottom frame piece side frame connectors 215, 225 are inserted into the respective corresponding slots of the corner connectors 235, 245 and the respective through holes are aligned to be concentric. The side frame connectors 215, 225 and the corner connectors may be secured to each other by the insertion of plastic screws 280 or other suitable fasteners into the aligned concentric through holes.

The frame system 200 is further comprised of a controller-memory assembly 300 configured with one or more applications for receiving, storing and displaying information, e.g. alphanumeric characters, symbols and graphics. The controller-memory assembly 300 is dimensioned to fit inside a frame recess 250, preferably in the bottom frame piece 220. The controller-memory assembly 300 can be further comprised of a voice-activated application interface, e.g. an "app" for translating voice commands into display configurations.

The frame assembly 200 is further comprised of a power assembly 400, e.g., a rechargeable/replaceable battery, an AC adapter connection, a solar cell, that is operably connected to the controller-memory assembly 300 by wiring (not shown), and activated/deactivated by a power switch 405.

The left side frame piece 220 is further comprised of a left side frame piece handle 231 disposed/attached thereon. The right side frame piece 230 is further comprised of a right side frame piece handle 241 disposed/attached thereon.

The frame assembly 200 is further comprised of an input interface 500, e.g., a USB port, an internet connection, a WI-FI interface, a Bluetooth interface, that is operably connected to the controller-memory assembly 300 by wiring (not shown).

The left side frame piece 230 and the right side frame piece 240 are each further comprised of Side Frame LED strip connectors 260 configured to releasably attach to a corresponding LED frame connector (110, 120) and to provide both physical attachment and electrical connectivity.

Electrical connectivity is provided from the power assembly 400 to the controller-memory assembly 300 to the LED assembly 100 (and thus the LED arrays) by internal frame wiring (not shown) and a connector system (110, 120, 260) configured for electrical connectivity to the internal frame wiring. The connector system is configured not only for physical connections for frame piece to frame piece and frame piece to LED assembly, but also for electrical connections through the connector system.

In some embodiments the frame assembly 200 can be further comprised of a removable LED stabilizing rim 270 configured for insertion into the frame recess 250 to facilitate structural integrity of the assembled frame pieces to the LED assembly 100.

REFERENCE NUMBER TABLE

| Ref. # | Description |
|---|---|
| 010 | Portable Digital Display |
| 100 | LED Assembly |
| 105 | LED Strips |
| 110 | LED Assembly Left Frame Connector |
| 120 | LED Assembly Right Frame Connector |
| 200 | Frame Assembly |
| 210 | Top Frame Piece |
| 215 | Top Frame Piece Side Frame Connector |
| 220 | Bottom Frame Piece |
| 225 | Bottom Frame Piece Side Frame Connector |
| 230 | Left Side Frame Piece |
| 231 | Left Side Frame Piece Handle |
| 235 | Left Side Frame Corner Connector |
| 240 | Right Side Frame Piece |
| 241 | Right Side Frame Piece Handle |
| 245 | Right Side Frame Piece Corner Connector |
| 250 | Frame Recess |
| 260 | Side Frame LED Strip Connector |
| 270 | LED Stabilizing Rim |
| 280 | Plastic Screws |
| 290 | Top/Bottom Frame Piece Through Holes |
| 295 | Side Frame Piece Through Holes |
| 300 | Controller-Memory Assembly |
| 400 | Power Assembly |
| 405 | Power Switch |
| 500 | Input Interface |

Although this technology has been illustrated and described herein with reference to preferred embodiments and specific examples thereof, it will be readily apparent to those of ordinary skill in the art that other embodiments and examples can perform similar functions and/or achieve like results. All such equivalent embodiments and examples are within the spirit and scope of the disclosed technology and are intended to be covered in the appended claims.

I claim:

1. A portable digital display comprising:

a collapsible frame having a top frame piece, a bottom frame piece, a left side frame piece, and a right side frame piece, each of the frame pieces having a recessed groove defined in a first side of each of the frame pieces and extending along a longitudinal axial length of each of the frame pieces so as to substantially form a c-shaped channel along the length of each frame piece, each of the top frame and bottom frame pieces being configured to be removably coupled to each of the left side and right side frame pieces such that the recessed grooves in each frame piece are aligned about a single plane;

one or more electrical frame connectors disposed within the recessed groove of at least one of the frame pieces;

one or more light emitting diode strips each having an array of light emitting diodes for creating a visual display, an LED connector in electrical communication with each of the light emitting diodes, and a plurality of perimeter edges, the light emitting diode strips being configured to be mated to the collapsible frame by the insertion of at least one perimeter edge of each light emitting diode strip within the longitudinal recessed grooves of at least one of the frame pieces, and wherein each LED connector is configured to be releasably coupled to, and in electrical communication with, at least one of the electrical frame connectors;

a controller-memory assembly disposed within the collapsible frame, the controller-memory assembly configured with one or more applications programmed to receive and store electronic information, and display electronic information on the light emitting diode strips;

a power assembly in electrical communication with the controller-memory assembly and the light emitting diode strips that is configured to provide power to the one or more light emitting diode strips and the controller-memory assembly, the power assembly including at least one input interface; and a wiring means in releasable electrical communication with the power assembly and each of the controller-memory assembly and the one or more light emitting diode strips for connecting the power assembly to the controller-memory assembly and the one or more light emitting diode strips.

2. The portable digital display of claim 1, further comprising:

a USB port in communication with the controller-memory assembly for connecting the portable digital device to third-party devices.

3. The portable digital display of claim 1, further comprising:

at least one wireless communication interface to connect with other devices.

4. The portable digital display of claim 1, further comprising:

a removable LED stabilizing rim disposed about the recessed groove of the collapsible frame and configured to facilitate structural integrity of the collapsible frame to the one or more light emitting diode strips.

5. The portable digital display of claim 1, wherein the controller-memory assembly includes a voice-activated interface for voice input to the controller-memory assembly.

6. The portable digital display of claim 1, wherein the power assembly includes a battery and a battery indicator in electrical communication with the battery to indicate the amount of electrical power remaining in the battery.

7. The portable digital display of claim 1, wherein the input interface provides means for charging the power assembly through either a USB device, a battery charger, or an AC adaptor.

8. A portable digital display comprising:

a collapsible frame having a top frame piece, a bottom frame piece, a left side frame piece, and a right side frame piece, each of the frame pieces having a recessed groove defined in a first side thereof and extending along a longitudinal axial length of each frame piece so as to substantially form a c-shaped channel along the length of each frame piece, each of the top frame and bottom frame pieces being configured to be removably coupled to each of the left side and right side frame pieces such that the recessed grooves in each frame piece are aligned about a single plane;

one or more electrical frame connectors disposed in the collapsible frame;

one or more light emitting diode strips each having an array of light emitting diodes for creating a visual display, an LED connector in electrical communication with each of the light emitting diodes, and a plurality of perimeter edges, the light emitting diode strips being configured to be mated to the collapsible frame by the insertion of at least one perimeter edge of each light emitting diode strip within the recessed grooves of at least one of the frame pieces, and wherein each LED connector is configured to be releasably coupled to, and in electrical communication with, at least one of the electrical frame connectors;

a controller-memory assembly disposed within the collapsible frame, the controller-memory assembly configured with one or more applications programmed to receive and store electronic information, and display electronic information on the light emitting diode strips;

a power assembly in electrical communication with the controller-memory assembly and the light emitting diode strips that is configured to provide power to the one or more light emitting diode strips and the controller-memory assembly, the power assembly including at least one input interface;

a wiring assembly in releasable electrical communication with the power assembly and each of the controller-memory assembly and the one or more light emitting diode strips for connecting the for connecting the power assembly to the controller-memory assembly and the one or more light emitting diode strips;

a USB port in communication with the controller-memory assembly for connecting the portable digital device to third-party devices;

a removable LED stabilizing rim disposed about the recessed grooves of the frame pieces of the collapsible frame and configured to facilitate structural integrity of the collapsible frame to the one or more light emitting diode strips; and a power level indicator in electrical communication with the power assembly to indicate the amount of electrical power in the power assembly.

9. The portable digital display of claim 8, wherein the controller-memory assembly includes a voice-activated interface for voice input to the controller-memory assembly.

10. The portable digital display of claim 8, wherein the input interface provides means for charging the power assembly through at least one of a USB device, a battery charger, or an AC adaptor.

11. A method of assembling a portable digital display, the method comprising:

providing a plurality of LED strips;

providing a frame assembly comprising a left side frame piece, a right side frame piece, a top side frame piece, and a bottom side frame piece, each frame piece having a recessed groove defined therein extending along a longitudinal axial length of each of the frame pieces so as to substantially form a c-shaped channel along the length of each frame piece, the recessed groove defining two opposing sidewalls;

coupling a removable LED stabilizing rim to each of the two opposing sidewalls of the recessed groove of each frame piece, each stabilizing rim being configured to slide over the respective sidewall and having a flange that slides into the recessed groove to provide lateral stability to the LED strips that are to be disposed therebetween;

attaching the left frame piece to the bottom frame piece;

attaching the right frame piece to the bottom frame piece;

positioning at least one LED strip into the recessed groove of both side frame pieces, such that the LED strips are disposed between the flanges of the LED stabilizing rims disposed in each recessed groove;

sliding each LED strip down the recessed grooves of both side pieces until the LED strip is inserted evenly and parallel to the recessed groove in the bottom frame piece;

connecting at least one side of each LED strip to a corresponding frame connector disposed within one of the left or right side frame pieces; and attaching the top frame piece to the upper end of each of the left and right side frame pieces.

* * * * *